US005133253A

United States Patent [19]

Barrus et al.

[11] Patent Number: 5,133,253

[45] Date of Patent: Jul. 28, 1992

[54] FLEXURE MEMBER IN CAM DRIVEN SHUTTLE PRINTER

[75] Inventors: Gordon B. Barrus, San Juan Capistrano; Leo J. Emenaker, El Segundo; Glen R. Radke, Huntington Beach, all of Calif.

[73] Assignee: Printronix, Inc., Irvine, Calif.

[21] Appl. No.: 423,491

[22] Filed: Oct. 12, 1989

Related U.S. Application Data

[63] Continuation of Ser. No. 145,125, Jan. 19, 1988, abandoned.

[51] Int. Cl.[5] ..... B41J 2/515

[52] U.S. Cl. ..... 101/93.04; 400/323

[58] Field of Search ..... 400/121, 323, 341; 101/93.04, 93.09

[56] References Cited

U.S. PATENT DOCUMENTS

| | | | |
|---|---|---|---|
| 3,332,343 | 7/1967 | Sims, Jr. | 101/93.16 |
| 3,911,814 | 10/1975 | Helms et al. | 101/93.16 |
| 3,941,051 | 3/1976 | Barrus et al. | 101/93.04 |
| 4,127,334 | 11/1978 | Watanabe et al. | 400/320 |
| 4,278,019 | 7/1981 | Meier | 101/93.04 |
| 4,353,262 | 10/1982 | Talbot | 400/320 |
| 4,387,642 | 6/1983 | Bringhurst et al. | 101/93.04 |
| 4,446,789 | 5/1984 | Matsumoto et al. | 400/320 |
| 4,498,793 | 2/1985 | Barrus et al. | 400/320 |
| 4,543,884 | 10/1985 | Kikuchi et al. | 101/93.04 |
| 4,573,363 | 3/1986 | Shin | 400/320 |

FOREIGN PATENT DOCUMENTS

| | | | |
|---|---|---|---|
| 98317 | 1/1984 | European Pat. Off. | 400/322 |
| 176063 | 10/1984 | Japan | 400/322 |
| 15170 | 1/1985 | Japan | 400/322 |

*Primary Examiner*—David A. Wiecking

*Attorney, Agent, or Firm*—Spensley, Horn, Jubas & Lubitz

[57] ABSTRACT

In a printer in which a shuttle is driven in reciprocating fashion by a rotating cam, a counterbalance assembly disposed on the opposite side of the cam from the shuttle and having a cam follower disposed along a common axis extending through the cam and a cam follower of the shuttle includes a mass in the form of a generally rectangular block mounting the cam follower at one of a pair of opposite ends thereof. Reciprocating movement of the block in response to rotation of the cam is provided by a pair of tapered flex pivots coupled to opposite ends of a base and extending upwardly and coupled to the opposite ends of the block. The end of the block opposite the cam follower receives a spring disposed against a reference surface to bias the cam follower against the cam.

4 Claims, 4 Drawing Sheets

FLEXURE MEMBER IN CAM DRIVEN SHUTTLE PRINTER

This is a continuation of copending application Ser. No. 07/145,125 filed on Jan. 19, 1988, now abandoned.

BACKGROUND OF THE INVENTION

1. Field of the Invention

The present invention relates to printers in which a shuttle is driven in reciprocating fashion by a rotatable cam, and more particularly to arrangements in which the rotatable cam is motor driven through a flywheel, the cam surface is oiled, and a counterbalance assembly is driven in reciprocating fashion by the cam in opposition to the shuttle.

2. History of the Prior Art

Printers are known in which a rotating cam is employed to reciprocate a shuttle. An example of such a printer is provided by U.S. Pat. No. 3,941,051 of Barrus et al., PRINTER SYSTEM, which patent issued on Mar. 2, 1976 and is commonly assigned with the present application. In the printer described in the Barrus et al. patent, a motor is coupled via a drive belt to rotate a flywheel which in turn is coupled to a cam. The cam engages a shuttle at one side thereof and a counterbalance assembly at an opposite side thereof. Engagement of the shuttle and the counter-balance assembly by the cam is effected through cam follower assemblies. The cam drives the shuttle and the counter-balance assembly in opposing reciprocating fashion. In this manner, movement of a mass within the counterbalance assembly is out of phase with movement of the shuttle assembly and counterbalances the shuttle assembly to thereby greatly minimize shaking and other vibratory motion within the printer.

Further examples of printers of the type shown in U.S. Pat. No. 3,941,051 of Barrus et al. are provided by copending application Ser. No. 069,486 of Farb et al., PRINTER HAVING INTERCHANGEABLE SHUTTLE ASSEMBLY, and copending application Ser. No. 069,021, Farb et al., PRINTER HAVING IMPROVED HAMMERBANK, both of which were filed Jul. 1, 1987 and are commonly assigned with the present application. The Farb et al. applications describe improved printers of the type disclosed in the Barrus et al. patent, such printers having readily interchangeable shuttle assemblies, improved hammerbanks and various other improved features. However, reciprocating shuttle motion is still carried out in such arrangements by a cam driven through a flywheel and also engaging a counterbalance assembly.

Printers of the type described in the Barrus et al. patent and the Farb et al. applications typically employ a counterbalance assembly which includes a mass in the form of a block of generally rectangular configuration having a cam follower assembly mounted within the block at one end thereof so that the cam follower of the assembly protrudes from the block and engages the cam. A spring disposed between a fixed reference and an opposite end of the block biases the block to maintain constant engagement of the cam follower with the cam. In such counterbalance arrangements, the block or other mass is typically mounted for reciprocating movement by one or more generally horizontally disposed shafts mounted on the housing for the printer and received within linear bearings in the block. Typically, the shafts must be spaced apart from the common axis through the cam and the cam followers of the counterbalance assembly and the shuttle, resulting in rotational and other components of force being applied to the linear bearings in addition to linear forces. Moreover, even where one or more shafts are located along or at least relatively close to the common axis, play within the linear bearings receiving such shafts is such that a tendency of the bearings to bind on the shafts is a constant problem. Moreover, the presence of the bearings and the shafts is an item of expense which may be further aggravated by the periodic need to replace the bearings and/or the shafts.

Accordingly, it would be advantageous to provide a counterbalance assembly in which the block or other mass is mounted for generally linear, reciprocating motion by a relatively inexpensive and simple arrangement which eliminates the need for linear bearings and shafts.

In the printers of the type described in the Barrus et al. patent and the Farb et al. applications, it is necessary that the surface of the cam be kept lubricated with a thin film of oil. This is normally accomplished by a wick positioned so as to contact the surface of the cam and provided with a quantity of lubricating oil. The wick bears against the rotating cam so as to replenish oil as necessary to maintain a film of the lubricating oil on the cam surface. However, such wicks which are typically made of fabric have been found to periodically dry out, requiring they be frequently examined and oil added thereto as necessary. If the wick nevertheless dries out prematurely or otherwise inadvertently, the lubricating film of oil on the cam surface will dissipate and this may result in erratic shuttle driving as well as premature wearing of the cam followers and the cam itself. Moreover, even where the wick is kept well oiled, the nature of the wick is such that a less than uniform film of oil may be maintained on the cam surface.

Accordingly, it would be desirable to provide a cam oiler which is capable of applying a relatively uniform, thin coating of lubricating oil to the cam surface and thereafter maintaining such lubricating film for a substantial period of time without the need for replenishing the oil in the oiler.

In printers of the type described in the Barrus et al. patent and the Farb et al. applications, the presence of a flywheel of substantial mass in conjunction with the cam is necessary because of the rather substantial inertia of the shuttle and the counterbalance assembly. Typically, the drive motor for the cam is coupled via a drive belt to a flywheel, with the flywheel being mounted on a common shaft with the cam. The drive motor rotatably drives the flywheel which in turn rotates the cam while at the same time imparting sufficient momentum to overcome the problems posed by the relatively high inertia of the shuttle and the counterbalance assembly. However, such driving arrangement occupies considerable space within the printer as well as adding to the expense of the printer because of the need for the separate motor, the flywheel and the drive belt therebetween. The presence of the drive belt coupling the motor to the flywheel introduces a further maintenance factor in terms of such things as wear and the occasional need to replace the drive belt.

Accordingly, it would be advantageous to provide a cam driving arrangement which is of more compact configuration and which eliminates the need for a drive belt or similar coupling between the motor and the flywheel.

BRIEF DESCRIPTION OF THE INVENTION

The foregoing and other objects and features in accordance with the invention are accomplished by a printer having a counterbalance assembly in which a block or other mass in constant camming engagement with the shuttle driving cam is mounted on at least one flex pivot. In a preferred embodiment, the mass is comprised of a generally rectangular block having a pair of flex pivots coupled to the opposite ends thereof to provide for generally linear motion of the block. The flex pivots which comprise relatively thin, generally planar, resilient leaf springs extend in generally parallel fashion between the opposite ends of the block and opposite ends of a base member disposed below the block and mounted on a portion of the printer frame. A spring disposed between a fixed reference surface and the end of the block opposite the end at which the cam follower is located acts to bias the cam follower into continuous engagement with the cam.

The flex pivots of counterbalance assemblies in accordance with the invention readily permit reciprocating, generally linear movement of the block in response to rotation of the cam to provide the desired counterbalancing action for either constant speed or variable speed driving of the shuttle assembly by the cam. The block basically moves along the common axis extending through the cam and the cam followers of the shuttle and the counterbalance assembly with only a relatively small component of vertical motion being present. The vertical component of motion has no significant effect on the counterbalancing action of block, and the need for linear bearings in conjunction with shafts or similar elements to mount the block is eliminated.

In printers according to the invention, the surface of the cam is kept oiled by an oiling system utilizing an element of porous material. Following the introduction of a quantity of oil into the porous element, the porous element remains wet with oil for substantial periods of time and resists any tendency to dry out. The porous element which is preferably made of ultra-high molecular weight sintered polyethylene material is continually biased against the surface of the cam by a mounting arrangement which includes a relatively thin, generally planar, resilient leaf spring having the porous element mounted thereon at one end thereof and having an opposite second end thereof coupled to a frame portion of the printer through a base bar. A clamping bar on the opposite side of the leaf spring from the base bar receives fasteners which extend through the clamping bar, the end of the leaf spring and the base bar and into the frame portion of the printer to mount the cam oiling system.

In printers according to the invention, the flywheel and the motor for rotatably driving the cam are combined into an integral structure which eliminates the need for a driving belt between the motor and the flywheel. The flywheel which is preferably of hollow, generally cylindrical configuration is integrally formed with the rotor of a DC motor. The rotor also includes the cam as a part thereof. The cam is disposed at the outer end of a shaft extending outwardly from within the flywheel along a common axis of the motor. A plurality of permanent magnets are mounted within the circular interior of the rotor inside of the flywheel. The permanent magnets surround and rotate relative to the plural coils extending around the generally circular outer periphery of a stationary stator. The stator includes a shaft extending along the common axis of the motor and having bearings thereon for rotatably receiving the cam and shaft of the rotor. A magnetic pickup responds to rotation of the flywheel to provide a continuous position signal representing the rotational position of the rotor relative to the stator. A plurality of Hall Effect sensors mounted on the stator provides commutation of the motor.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
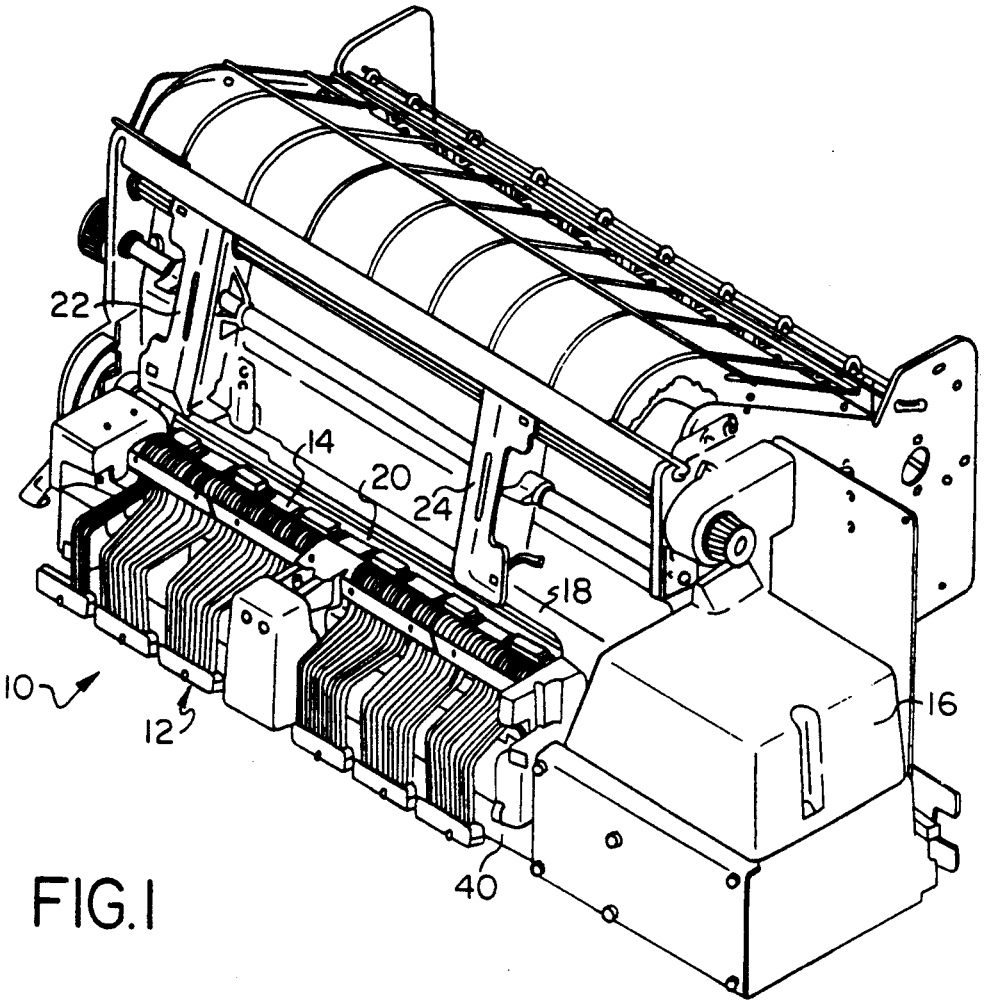
FIG. 1 is a perspective view of a printer having a shuttle counterbalance assembly, a cam oiler and an integral flywheel motor in accordance with the invention.

FIG. 1 depicts a printer 10 having a shuttle counterbalance assembly, a cam oiler system and an integral flywheel motor in accordance with the invention. The printer 10 is similar in terms of its basic organization and operation to the printer described in the previously referred to U.S. Pat. No. 3,941,051 of Barrus et al. The printer 10 is described in greater detail in the previously referred to co-pending applications of Farb et al., Ser. No. 069,486 and Ser. No. 069,020. The Barrus et al. patent and the Farb et al. applications are incorporated herein by reference.

The printer 10 includes a shuttle assembly 12 having an elongated shuttle 14 mounted therein for movement along an axis. The elongated shuttle 14 is driven in reciprocating fashion by a cam drive assembly which is hidden by a cover 16 in FIG. 1 and which is described in detail hereafter. The cam drive assembly also drives a counterbalance assembly in reciprocating fashion in order to counterbalance the elongated shuttle 14 and thereby minimize vibratory motion within the printer 10. The counterbalance assembly which is also hidden by the cover 16 is described in detail hereafter.

The elongated shuttle 14 is disposed adjacent and yet slightly spaced-apart from an elongated platen 18 so as to form a print station 20 in the form of a uniform gap therebetween. When the printer 10 is loaded with print paper, the print paper extends upwardly through the print station 20 and into engagement with opposite tractor drives 22 and 24. The tractor drives 22 and 24 increment the print paper upwardly through the print station 20 as successive lines of dots are printed on the print paper by the shuttle 14.

The shuttle 14 is basically comprised of an elongated hammerbank having hammer springs mounted along the length thereof. Magnetic circuits associated with the various hammer springs are selectively actuated during reciprocation of the elongated shuttle 14, and this causes the hammer springs to momentarily move toward the print paper so that dot printing impact tips mounted on the hammer springs impact a length of ink ribbon (not shown for simplicity of illustration) against the print paper to print dots. This operation of the printer 10 is described in detail in the previously referred to co-pending applications of Farb et al.

Figure 2:
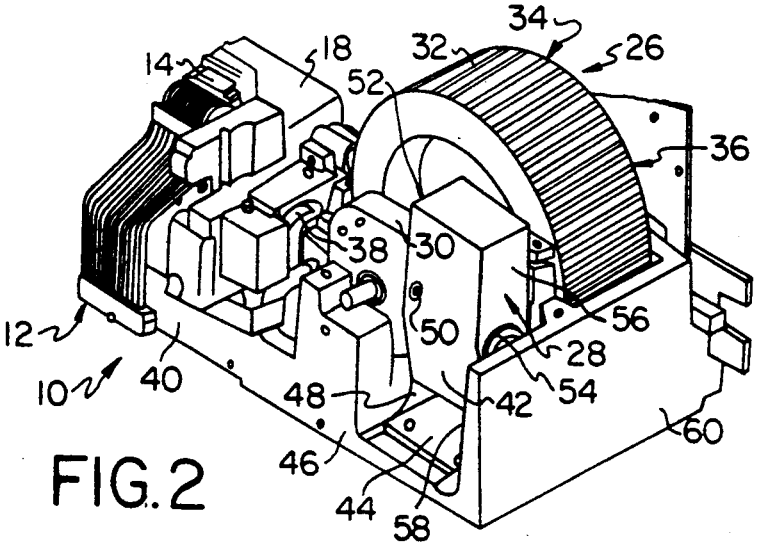
FIG. 2 is a perspective view of a portion of the printer of FIG. 1 with a cover thereof removed to show the counterbalance assembly and the integral flywheel motor.

FIG. 2 depicts a portion of the printer 10 with the cover 16 removed in order to show a cam drive assembly 26 and a counterbalance assembly 28 in accordance with the invention. The cam drive assembly 26 includes a cam 30 which together with a flywheel 32 forms the major portion of a rotor 34 of an integral flywheel motor 36 in accordance with the invention. The motor 36 is described in detail hereafter in connection with FIGS. 7-9.

During operation of the printer 10, the motor 36 rotatably drives the cam 30. The elongated shuttle 14 has a cam follower assembly 38 coupled to one end thereof. The cam follower assembly 38 remains in contact with the cam 30. Consequently, as the cam 30 rotates, the shuttle 14 undergoes reciprocating motion relative to a supporting frame 40 of the shuttle assembly 12.

The shape of the cam 30 determines the velocity profile of the shuttle 14 which may be either essentially constant velocity or varying velocity during each shuttle stroke. Rotation of the cam 30 by the motor 36 also produces reciprocation of the counterbalance assembly 28 in an opposite, out of phase relation to the reciprocating shuttle 14. Thus, when the shuttle 14 is driven in a direction away from the cam 30, the counterbalance assembly 28 is also driven in a direction away from the cam 30. Conversely, when the shuttle 14 moves in a direction toward the cam 30, the counterbalance assembly 28 also moves in a direction toward the cam 30. In this manner the counterbalance assembly 28 acts to counterbalance the reciprocating shuttle 14 so that vibratory motion within the printer 10 in minimized.

Figure 5:
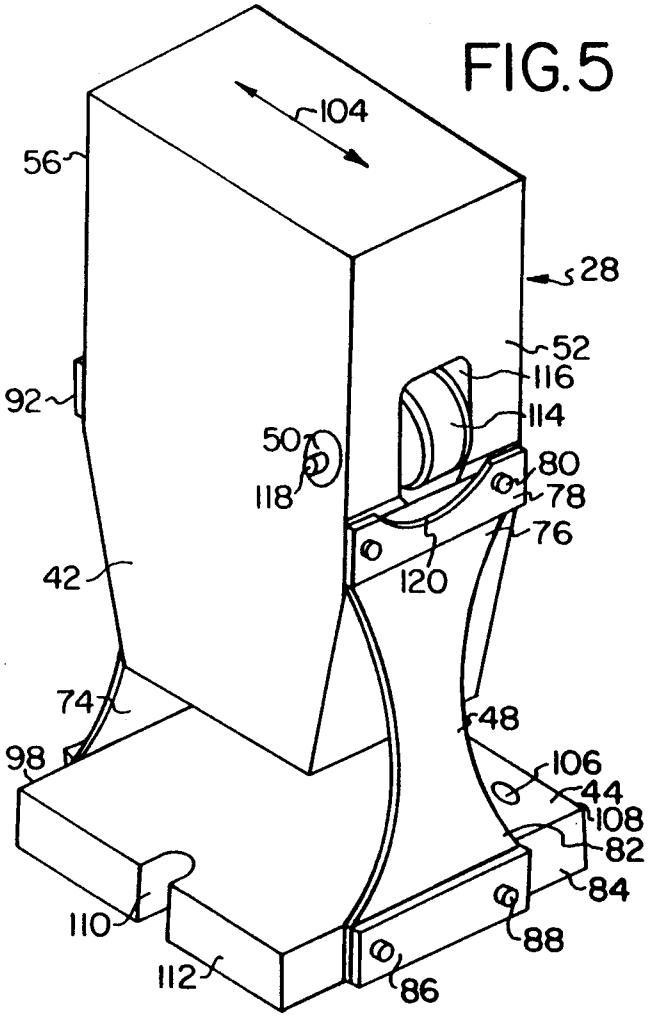
FIG. 5 is a left rear perspective view of the counterbalance assembly of FIGS. 1-3.
Figure 4:
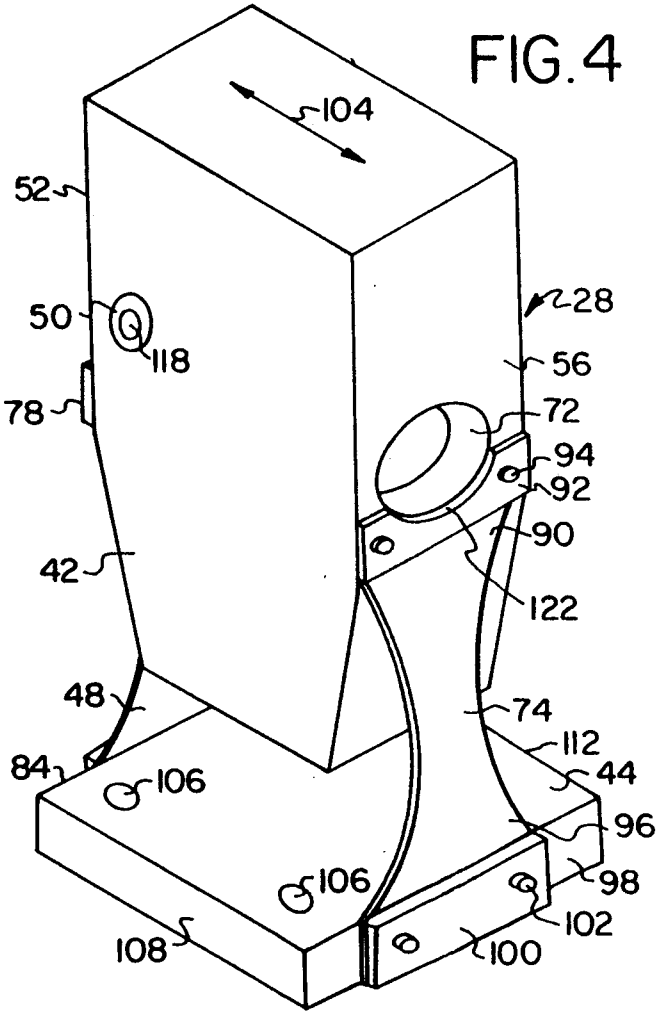
FIG. 4 is a right front perspective view of the counterbalance assembly of FIGS. 1-3.

The counterbalance assembly 28, which is described in greater detail hereafter in connection with FIGS. 4 and 5, includes a reciprocating mass in the form of a block 42 and a base 44 disposed beneath the block 42. The base 44 is mounted on a frame 46 of the printer 10. The block 42 is coupled to the base 44 by an opposite pair of flex pivots, with one such flex pivot 48 being shown in FIG. 2. The cam follower assembly 50 is mounted within the block 42 so as to extend from a first end 52 of the block 42 into contact with the cam 30. The cam follower assembly 50 is maintained in engagement with the cam by the bias provided by a resilient spring 54. The spring 54 extends between an opposite second end 56 of the block 42 and a fixed reference surface provided by an inner surface 58 of an end wall 60 of the printer frame 46.

Figure 3:
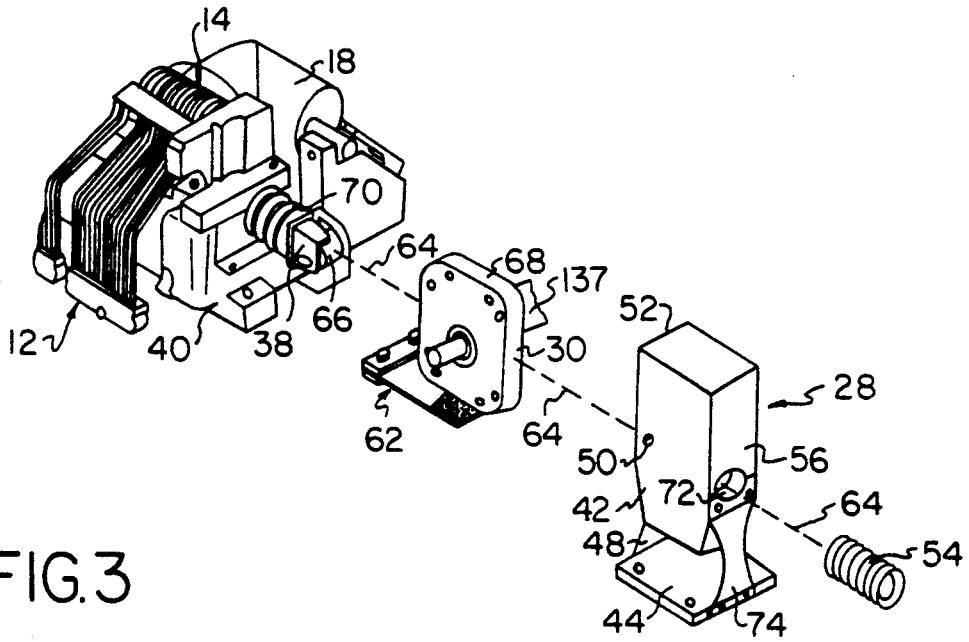
FIG. 3 is an exploded perspective view of a portion of the apparatus shown in FIG. 2 and illustrating the counterbalance assembly and the cam oiler in conjunction with the cam and the cam follower assembly of the shuttle.

FIG. 3 is a exploded perspective view showing the interrelationship between the cam 30 and the shuttle 14 and the counterbalance assembly 28. FIG. 3 also illustrates a cam oiler 62 in accordance with the invention. The cam 30 is shown as having four lobes for purposes of illustration only, and it will be understood by those skilled in the art that cams of other configurations or having different numbers of lobes can be used in accordance with the invention.

As illustrated in FIG. 3, the cam 30 lies along a common axis 64 together with the cam follower assembly 38 of the shuttle 14 and cam follower assembly 50 of the counter-balance assembly 28. This linear relationship is important in terms of the counterbalance assembly 28 effectively counterbalancing the shuttle 14. The cam follower assembly 38 of the shuttle 14 includes a cam follower 66 which is maintained in constant engagement with an outer surface 68 of the cam 30 by a spring 70. The cam follower assembly 50 of the counterbalancing assembly 28 includes a cam follower which is described hereafter in connection with FIG. 5 and which is maintained in constant engagement with the outer surface 68 of the cam 30 by the spring 54. The spring 54 extends between the inner surface 58 of the end wall 60 as shown in FIG. 2 and a circular recess 72 within the second end 56 of the block 42. The counterbalance assembly 28 is provided with a second flex pivot 74 in addition to the flex pivot 48.

The counterbalance assembly 28 is shown in detail in FIGS. 4 and 5. As shown therein, the flex pivots 48 and 74 each comprise a relatively thin, generally planar leaf spring of resilient material which tapers gradually from a maximum width at the opposite ends thereof to a minimum width at the center thereof. The tapered configuration provides uniform stress distribution by distributing stress over the length of the spring. The flex pivot 48 has an upper end 76 thereof which is coupled to the first end 52 of the block 42 by a mounting plate 78 and a pair of fasteners 80. The fasteners 80 extend through the mounting plate 78, through the upper end 76 of the flex pivot 48 and into the first end 52 of the block 42. The flex pivot 48 extends downwardly from the upper end 76 thereof to an opposite lower end 82 thereof secured to a first end 84 of the base 44 by a mounting plate 86 and a pair of fasteners 88. The fasteners 88 extend through the mounting plate 86, the lower end 82 of the flex pivot 48 and into the first end 84 of the base 44.

As shown in FIG. 4, the second flex pivot 74 is of like configuration to the flex pivot 48 and is secured to the block 42 and the base 44 in similar fashion. Thus, the flex pivot 74 has an upper end 90 thereof secured to the second end 56 of the block 42 by a mounting plate 92 and a pair of fasteners 94. An opposite lower end 96 of the flex pivot 74 is secured to a second end 98 of the base 44 opposite the first end 84 by a mounting plate 100 and a pair of fasteners 102.

The flex pivots 48 and 74 are generally parallel to each other and permit reciprocating movement of the block 42 in opposite directions relative to the base 44 in generally linear fashion as represented by an arrow 104 in FIGS. 4 and 5. The first end 52 of the block 42 tapers inwardly below the upper end 76 of the flex pivot 48 to provide clearance relative to the flex pivot 48 during reciprocating motion of the block 42. Similarly, the opposite second end 56 of the block 42 tapers inwardly beneath the upper end 90 of the flex pivot 74 to provide ample clearance between the block 42 and the flex pivot 74.

The base 44 has a pair of apertures 106 adjacent a front edge 108 thereof and a slot 110 in an opposite rear edge 112 thereof. The apertures 106 and the slot 110 receive screws or other fasteners for securing the base 44 of the counterbalance assembly 28 to the frame 46 of the printer 10.

The cam follower assembly 50 includes a cam follower 114 disposed within a slot 116 in the first end 52 of the block 42. The cam follower 114 is mounted for rotation about a pin 118 which extends through the thickness of the block 42 adjacent the first end 52 thereof. The pin 118 is positioned so that the cam follower 114 extends partially outside of the block 42. The cam follower 114 is maintained in continuous contact with the outer surface 68 of the cam 30 by the spring 54. As previously noted, the spring 54 extends between the inner surface 58 of the end wall 60 of the frame 46 of the printer 10 and the circular recess 72 within the second end 56 of the block 42.

The mounting plate 78 at the upper end 76 of the flex pivot 48 has a semi-circular recess 120 therein to provide clearance for the cam follower 114. Similarly, the mounting plate 92 at the upper end 90 of the flex pivot 74 has a semi-circular recess 122 therein to provide clearance for the end of the spring 54 which is inserted in the circular recess 72.

Figure 6:
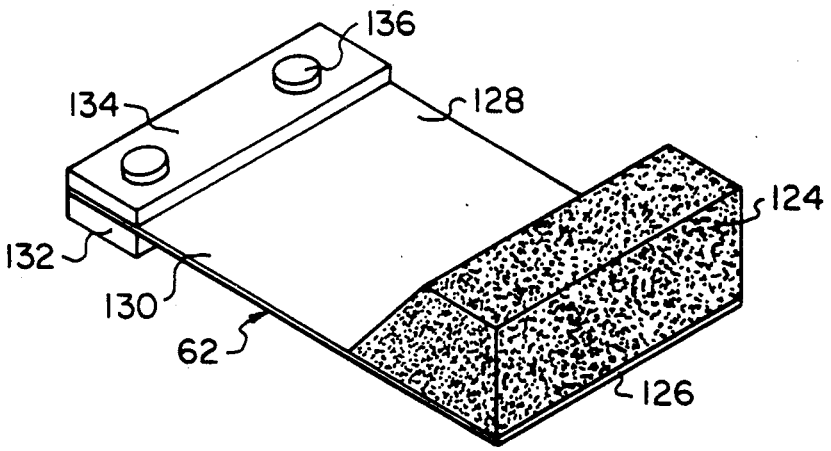
FIG. 6 is a perspective view of the cam oiler of FIGS. 1-3.

The cam oiler 62 is shown in detail in FIG. 6. The oiler 62 includes a porous element 124 which is of elongated configuration and which is preferably comprised of ultra-high molecular weight sintered polyethylene. The porous element 124 is mounted on a first end 126 of a relatively flat, generally planar leaf spring 128 which is comprised of resilient material such as beryllium copper.

The porous element 124 may be coupled to the first end 126 of the leafspring 128 by heat fusion, the leafspring 128 having holes in the first end 126 through which the porous element 124 protrudes to facilitate the heat fusion bonding. The leaf spring 128 has a second end 130 opposite the first end 126 which is coupled to the frame 46 of the printer 10 by a mounting arrangement including a base bar 132 and a clamping bar 134. A pair of fasteners 136 comprising screws or other appropriate fastening elements extend through the clamping bar 134, the second end 130 of the leaf spring 128 and the base bar 132 and into the frame 40 of the printer 10. The base bar 132 and the clamping bar 134 are of elongated configuration and are disposed opposite each other at opposite sides of the leaf spring 128.

The base bar 132 holds the leaf spring 128 spaced apart from the frame 46 of the printer 10, permitting the leaf spring 128 to flex without engaging the frame 46. The resiliency of the leaf spring 128 maintains the porous element 124 in contact with the outer surface 68 of the cam 30 as the cam 30 rotates, the leaf spring 128 flexing as necessary as the various lobes on the cam 30 pass the porous element 124.

The porous element 124 is provided with a quantity of oil. The continuous contacting of the outer surface 68 of the cam 30 by the porous element 124 maintains a thin film or coating of the oil on the surface 68 at all times. The oil is preferably of the high surface tension type, an example being oil sold under the designation Tellus 100 by Shell Oil Company. The voids in the sintered polyethylene comprising the porous element 124 control the metering of oil onto the cam surface 68 by capillary action to maintain a thin film of oil on the surface 68. The porous element 124 needs to be re-oiled only infrequently.

Figure 8:
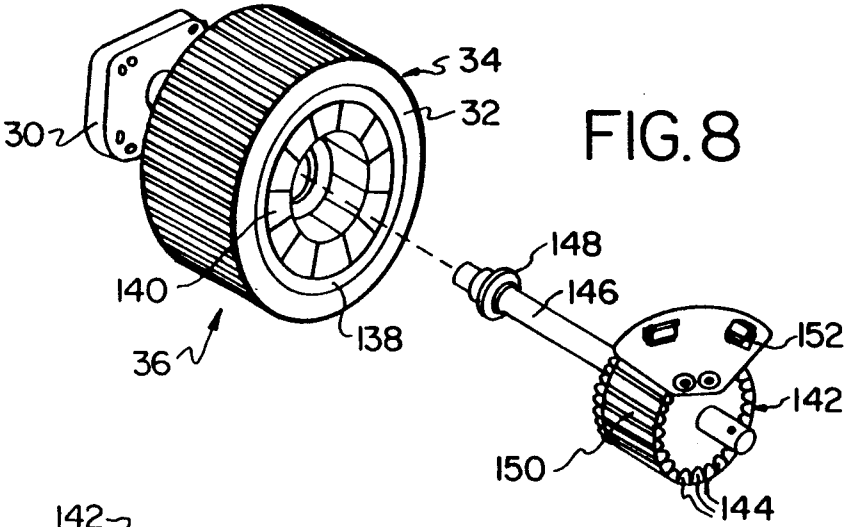
FIG. 8 is an exploded perspective view of the integral flywheel motor of FIGS. 1 and 2 showing the stator of the motor.
Figure 7:
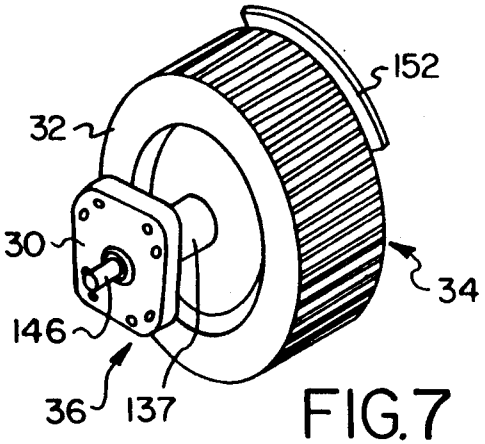
FIG. 7 is a perspective view of the integral flywheel motor of FIGS. 1 and 2 showing the rotor of the motor including the cam and the integral flywheel.
Figure 9:
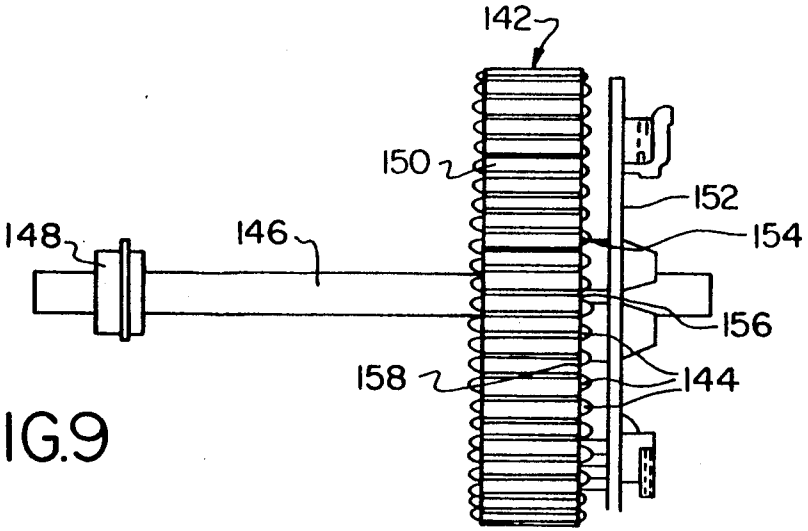
FIG. 9 is a top view of the stator of the integral flywheel motor of FIGS. 1 and 2.

The motor 36 is shown in detail in FIGS. 7–9. As previously noted, the rotor 34 of the motor 36 includes the cam 30 and the flywheel 32 which are integrally formed therewith. The flywheel 32 is of hollow, generally cylindrical configuration, and the cam 30 is formed at the end of a shaft 146 which extends outwardly from the hollow interior of the flywheel 32. As seen in FIG. 8, the rotor 34 has a generally circular interior surface 138 within the flywheel 32. A plurality of permanent magnets 140 are mounted around the interior surface 138.

The motor 36 includes a stator 142 which has a plurality of coils 144 disposed adjacent the circular outer periphery thereof. The stator 142 includes a shaft 146 extending rearwardly therefrom and having a bearing 148 mounted thereon. With the stator 142 mounted within the rotor 34, the bearing 148 is received within the interior of the shaft 137 in the vicinity of the cam 30 to facilitate rotation of the rotor 34 about the stator 142. A generally cylindrical outer surface 150 of the stator 142 forms a small air gap with the permanent magnets 140 of the rotor 34. The coils 144 are energized in conventional D.C. motor fashion to provide rotation of the rotor 34 relatively to the stator 142. Electrical connections to the coils 144 are facilitated by a circuit board 152 coupled to the front of the stator 142. A magnetic pickup (not shown) responds to rotation of the flywheel 32 to provide a continuous position signal representing the rotational position of the rotor relative to the stator in the manner described in the previously referred to U.S. Pat. No. 3,941,051 of Barrus et al. This signal is used by the printer 10 to provide an indication of the location of the shuttle 14 as it reciprocates, and this indication in turn is used to control the timing of the release or firing of the hammer springs located along the length of the hammerbank of the shuttle 14. As previously noted the shuttle 14 may be driven at essentially constant velocity or with varying velocity over each stroke thereof. Also, the velocity profile can change for different modes of printer operation.

Three different Hall Effect sensors 154, 156, and 158 are mounted within the front of the stator 142 adjacent the outer surface 150 and are slightly spaced-apart from each other as shown in FIG. 9. The Hall Effect sensors 154, 156, and 158 provide for commutation of the motor 36.

It will be appreciated that by incorporating the cam 30 and the flywheel 32 into the rotor 34 of the motor 36, the need for a drive belt or other coupling between the drive motor and the flywheel for the cam is eliminated.

While there have been described above and illustrated in the drawings a number of variations, modifications and alternative forms, it will be appreciated that the scope of the invention defined by the appendant claims includes all forms comprehended thereby.

What is claimed is:

1. In a printer in which a mass is moved in reciprocating fashion, an arrangement for mounting the mass to permit reciprocating motion thereof, including at least one flex pivot in the form of an elongated, resiliently flexible member having a first end thereof mounted on a fixed reference and an opposite second end coupled to the mass, the elongated, resiliently flexible member being of tapered configuration and having a width which decreases from given values at opposite first and second ends thereof to a lesser value at a location intermediate the first and second ends.

2. The invention set forth in claim 1, wherein the elongated, resiliently flexible member has opposite edges extending between the first and second ends which are generally arc-shaped.

3. In a printer, the combination comprising a shuttle, a rotatable cam coupled to the shuttle and operative to drive the shuttle in reciprocating fashion, and a counterbalance assembly having a mass supported by an opposite pair of flex pivot mounts and a cam follower assembly mounted on the mass, the cam follower assembly engaging and being driven by the cam to drive the mass in reciprocating fashion and being disposed on an opposite side of the cam from the shuttle so that rotation of the cam drives the shuttle and the mass with the included cam follower in an opposite, out-of-phase manner, each of the opposite pair of flex pivot mounts comprising an elongated, resiliently flexible member of tapered configuration and the elongated, resiliently flexible member having a width which decreases from given values at opposite first and second ends thereof to a lesser value at a location intermediate the first and second ends.

4. The invention set forth in claim 3, wherein the elongated, resiliently flexible member as opposite edges extending between the first and second ends which are generally arc-shaped.

* * * * *